US005924710A

United States Patent [19]

de Courcey Milne

[11] Patent Number: 5,924,710

[45] Date of Patent: Jul. 20, 1999

[54] SPORTS CONVEYANCE SUSPENSION SYSTEMS

[76] Inventor: John de Courcey Milne, Unit 6, 39 Grosvenor Street, Balmoral QLD 4171, Australia

[21] Appl. No.: 08/817,840

[22] PCT Filed: Oct. 30, 1995

[86] PCT No.: PCT/AU95/00727

§ 371 Date: Jul. 7, 1997

§ 102(e) Date: Jul. 7, 1997

[87] PCT Pub. No.: WO96/13309

PCT Pub. Date: May 9, 1996

Related U.S. Application Data

[30] Foreign Application Priority Data

Oct. 28, 1997 [AU] Australia ..... PM 9112

[51] Int. Cl.[6] ..... A63C 17/04

[52] U.S. Cl. ..... 280/87.042; 280/11.28

[58] Field of Search ..... 280/87.01, 87.021, 280/87.041, 87.042, 11.28, 15, 17, 11.115

[56] References Cited

U.S. PATENT DOCUMENTS

| | | | |
|---|---|---|---|
| 4,054,297 | 10/1977 | Solimine | 280/87.042 |
| 4,403,784 | 9/1983 | Gray | 280/11.28 |
| 4,740,000 | 4/1988 | Moessner | 280/7.12 |
| 5,161,810 | 11/1992 | DeCesare | 280/15 |
| 5,169,166 | 12/1992 | Brooks | 280/87.042 |
| 5,232,235 | 8/1993 | Brooks | 280/87.042 |
| 5,330,214 | 7/1994 | Brooks et al. | 280/87.042 |
| 5,513,865 | 5/1996 | Brooks et al. | 280/87.042 |
| 5,551,717 | 9/1996 | Milne | 280/87.041 |

FOREIGN PATENT DOCUMENTS

| | | | |
|---|---|---|---|
| 34630/84 | 5/1985 | Australia . | |
| 446984 | 3/1968 | Switzerland | 280/87.042 |
| 2225990 | 6/1990 | United Kingdom | 280/87.042 |
| WO 93/20911 | 10/1993 | WIPO . | |
| WO 94/19072 | 9/1994 | WIPO . | |

*Primary Examiner*—J J Swann
*Assistant Examiner*—Frank Vanaman
*Attorney, Agent, or Firm*—Christensen O'Connor Johnson & Kindness PLLC

[57] ABSTRACT

A sports conveyance (10) of the type having a substantially rectangular elongate board (11) mounted on a frame (12) supported at its rear by rear wheel means (13) and at or towards its front by a pair of spaced apart front wheels (14). The frame (12) includes a main frame assembly (20) and two subframes (21), the latter being mounted in opposed dispositions on opposite sides of said main frame assembly, each subframe (21) having a transverse arm (22) rigidly connected at its outer end (23) to the respective wheel mounting (24), while its inner end (25) is pivotally connected to said main frame assembly (20) at or adjacent said longitudinal tilt axis of the board, bias or damping means (27) being associated with the inner ends of the transverse arms (22), and the parts being so made and arranged that the transverse arms may pivot about their inner ends under operating or load conditions against the action of said bias or damping means (27), the latter acting to return the transverse arms (22) to initial dispositions upon cessation of said operating or load conditions.

12 Claims, 4 Drawing Sheets

SPORTS CONVEYANCE SUSPENSION SYSTEMS

TECHNICAL FIELD OF THE INVENTION

THIS INVENTION relates to sports conveyance suspension systems, and it has more particular but not exclusive reference to improvements in suspension systems for sports conveyances of the type described and illustrated in my Australian Patent Application No. 38801/93.

BACKGROUND ART

Sports conveyances made in accordance with the invention disclosed in the said Australian patent application are proving very successful in achieving the objects for which the invention was devised, and although a number of differing practical embodiments were embraced thereby, the broadest concept resides in a sports conveyance having a substantially rectangular elongate board mounted on a frame supported at its rear by rear wheel means and at or towards its front by a pair of spaced front wheels at equal distances on opposite sides of the medial longitudinal axis of the board which is the basic line of motion, the front wheels being rotatable about axes transverse to said line of motion and having interconnecting means whereby they may be turned in unison to either side of said line of motion, the board serving as a stand for a rider and being so mounted on the frame as to be tiltable to either side about said longitudinal axis of the board when depressed at a respective side, the board being adapted to be disposed in a substantially horizontal inoperative attitude in which the front wheels are unturned but so connected to the said interconnecting means of the front wheels that depression of the board by body weight of the rider at a respective side of the board causes turning of the front wheels in unison in the corresponding direction. This basic construction will herein be termed "a conveyance of the general type described".

While various additional preferred features have been described and illustrated in the said Australian Application No. 38801/93, I have found it most desirable to have the frame designed to be low to the ground and supporting the tiltable board thereabove at a level not appreciably above a horizontal plane through the transverse axis of the front wheels, the front end of the board suitably being extended beyond the front transverse wheel axis so that the rider's foot can be supported thereon as "front" foot support when he is facing across the board in operation, his other or "rear" foot being at the back of the deck which in that instance suitably terminates short of the rear wheel location so that a toe-heel tilt action is easily accomplished.

My present invention has for its principal object to improve further on the successful designs of conveyances made to date in accordance with the earlier basic invention, particularly in relation to improved suspension systems whereby the conveyances will be even easier to ride and more comfortable than the conveyances made to date. In particular it is aimed to achieve increased safety by ensuring increased stability over rough terrain. Further objects and advantages of the invention herein will be understood as the descriptions of preferred embodiments progress.

DISCLOSURE OF THE INVENTION

With the foregoing and other objects in view, my present invention resides broadly in a sports conveyance of the general type described, characterised in that the frame supporting the board for tilting of the latter about the said longitudinal axis includes a main frame assembly at said axis and two sub-frames, the latter being mounted in opposed dispositions on opposite sides of said main frame assembly, each sub-frame having a transverse arm rigidly connected at its outer end to the respective wheel mounting, while its inner end is pivotally connected to said main frame assembly at or adjacent said longitudinal tilt axis of the board, bias or damping means being associated with the inner ends of the transverse arms, and the parts being so made and arranged that the transverse arms may pivot about their inner ends under operating or load conditions against the action of said bias or damping means, the latter acting to return the transverse arms to initial dispositions upon cessation of said operating or load conditions.

In one embodiment, each transverse arm is V-shaped in front view, its inner and outer ends being elevated relative to its middle section at which the angle between the inner and outer ends is adapted to accommodate the adjacent edge of the platform when tilted, thus permitting the board to be mounted on the frame at a level closely above the inner ends of the transverse arms.

Preferably, the two transverse arms are of the same thickness in the direction along the longitudinal axis, their front faces being disposed in the same transverse vertical plane, while their rear faces are disposed in another transverse vertical plane.

In certain embodiments, the inner ends of the two transverse arms have their pivot axes closely adjacent but in spaced relationship at the same height on the frame and at substantially the same height as the transverse front wheel axes. However, in other embodiments, the inner ends of the two transverse arms have their pivot axes coinciding on a common axis located on or closely adjacent said longitudinal tilt axis of the board, said common axis being at substantially the same height as the transverse front wheel axes.

While the bias or damping means could take various forms, such as blacks of polyurethane or rubber, it is preferred that at least one tension spring be used. In one embodiment, the bias or damping means includes a single tension spring interconnecting the two transverse arms at positions thereon which are equidistant from their respective pivot axes and less than the distance from each pivot axis to the middle of the respective arm. However, in another embodiment, the bias or damping means includes a pair of tension springs each connected between a respective transverse arm and a common mounting member rigid with the main frame assembly adjacent said tilt axis, the parts being so made and arranged that each transverse arm is subject to bias or damping action independently of the other.

In all cases, it is preferred that the frame includes a single medial longitudinal frame member extending beneath the board and constituting at its forward end said main frame assembly for connection to said sub-frames while the rear of the frame member is shaped to fork-like form to accommodate a single rear wheel constituting said rear wheel means.

Other features may be provided, particularly to suit the various boards illustrated in my earlier patent application including frames having spaced longitudinal frame bars substantially parallel to one another. A feature of the invention is that the tension spring or springs or other bias or damping means will pull the lower ends of the front wheels towards one another taking into account the fact that the wheels tend to move slightly apart under operational conditions including supporting the weight of the rider. Other features of the invention will become apparent from the following descriptions.

BRIEF DESCRIPTION OF THE DRAWINGS

In order that the invention may be more readily understood and put into practical effect, reference will now be made to the accompanying drawings, wherein.

BEST MODE FOR CARRYING OUT THE INVENTION

Figure 1:
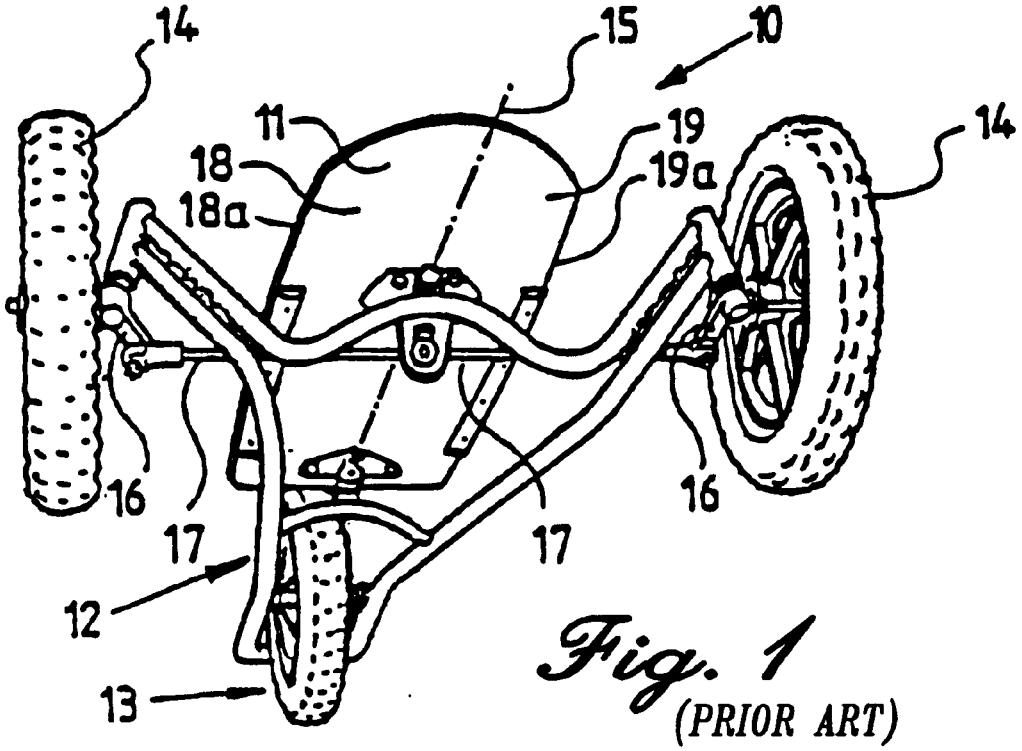
Fig. 1 (PRIOR ART)
FIGS. 1 and 2 are perspective views from underneath a typical prior art conveyance the subject of my Australian patent application No. 38801/93, showing the front wheels unturned in FIG. 1 and turned to one side in FIG. 2, allowing comparison with the advances brought by the present invention.
Figure 2:
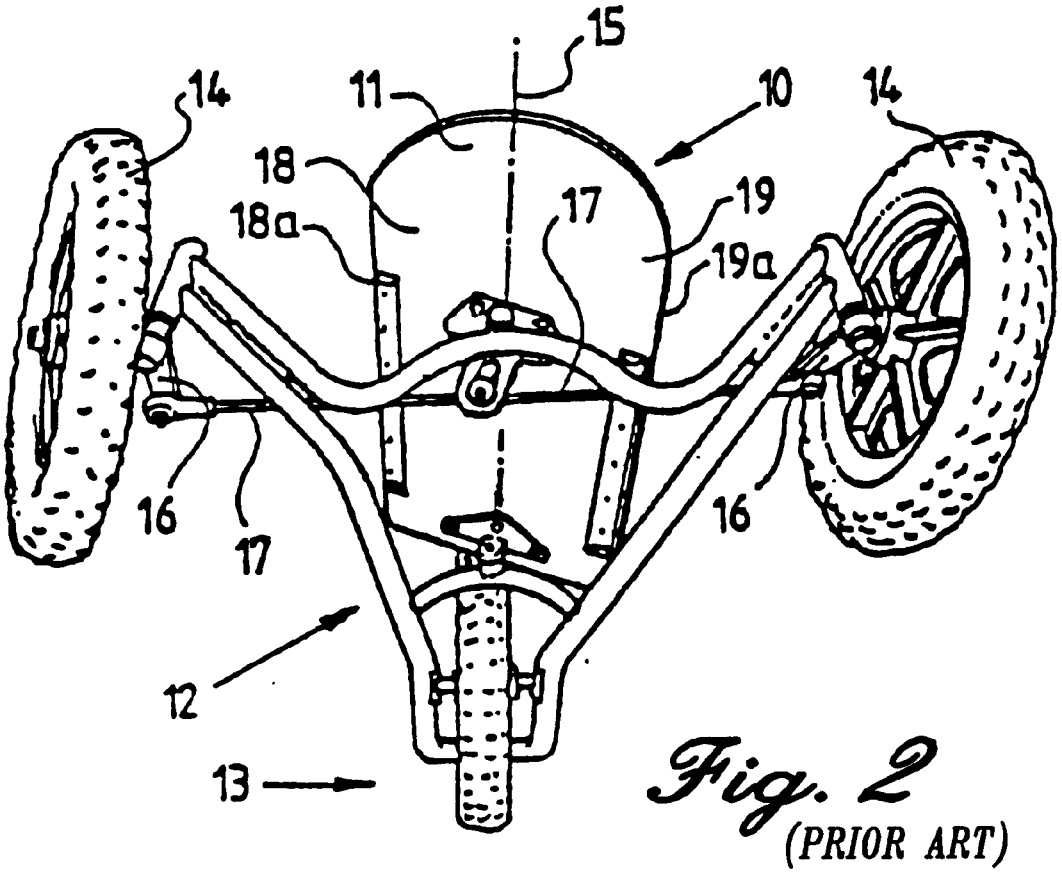
Fig. 2 (PRIOR ART)
Figure 3:
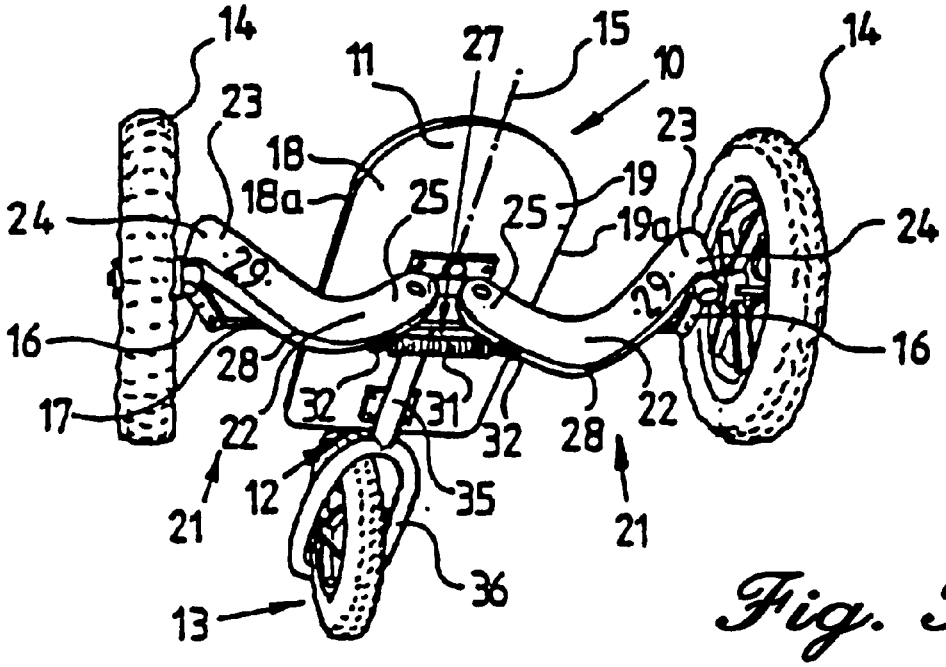
FIGS. 3 and 4 are perspective views from underneath a conveyance according to one embodiment of the present invention, the views in FIGS. 3 and 4 corresponding to those of FIGS. 1 and 2 respectively.
Figure 4:
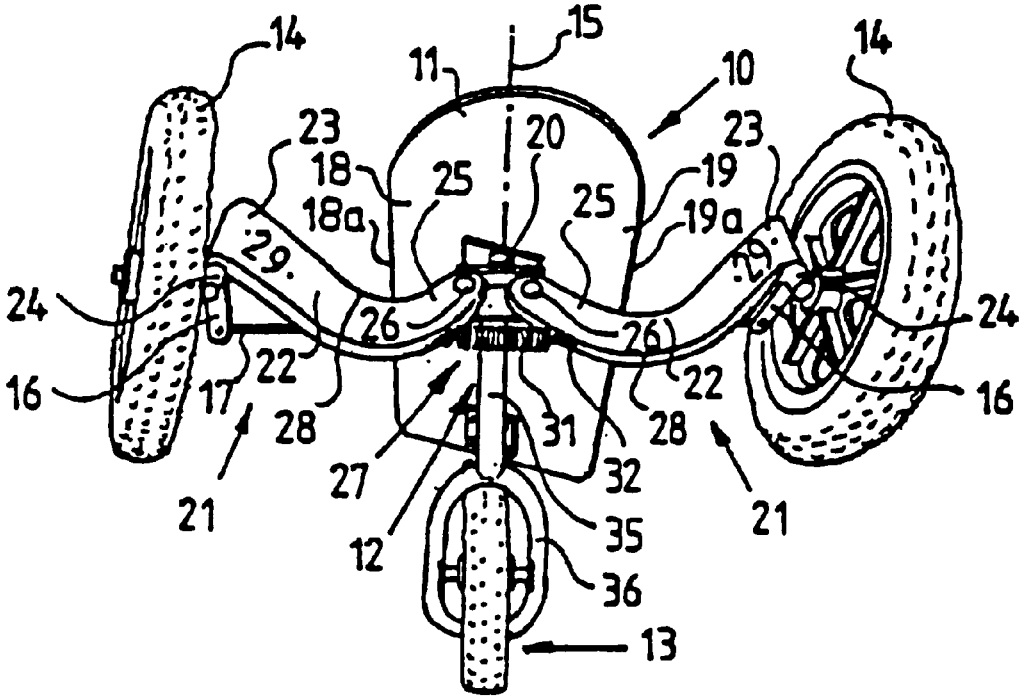
Figure 5:
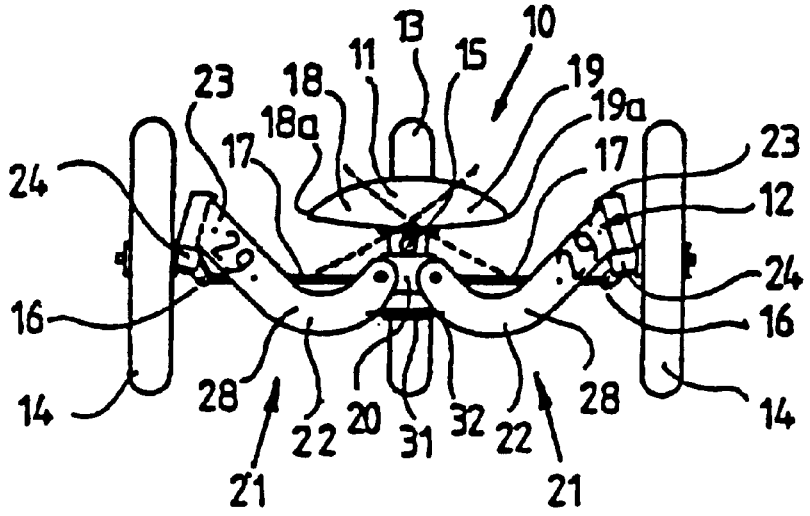
FIG. 5 is a front view of the conveyance of FIGS. 3 and 4, showing the degree of tiltability of the board as permitted by the V-shaped transverse arms of the sub-frames provided by the invention.
Figure 6:
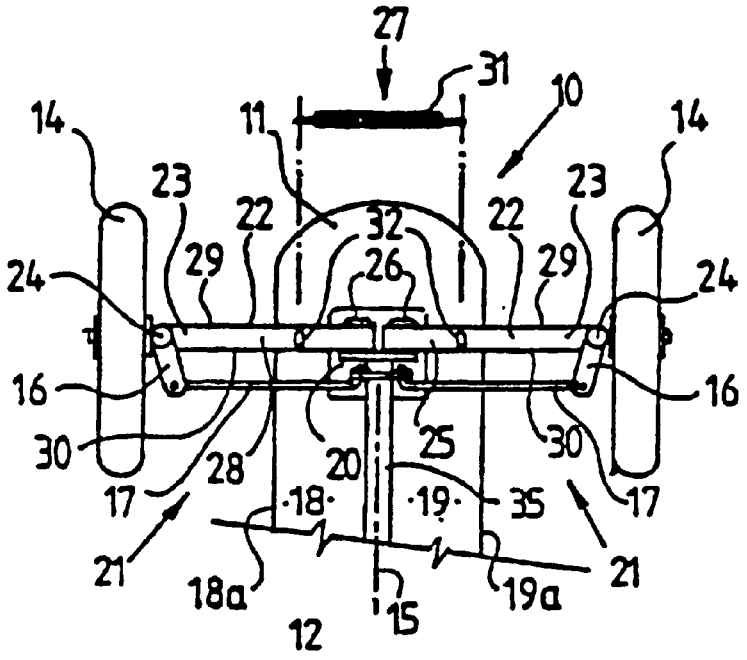
FIG. 6 is a broken-away inverted plan view of the conveyance of FIGS. 3 to 5, with the single tension spring shown in separated relationship for the sake of clarity.

The prior art conveyance shown in FIGS. 1 and 2 is an embodiment of my earlier invention and as described with reference to FIGS. 3 and 4 of my Australian Patent Application No. 38801/93 to which reference should be made if necessary for a detailed explanation of the components, the conveyance 10 therein being of the general type having a substantially rectangular elongate board 11 (also called deck or platform in the trade concerned) mounted on a frame indicated generally at 12 which is supported at its rear by a rear wheel assembly 13 and at or towards its front by a pair of spaced front wheels 14 at equal distances on opposite sides of the medial longitudinal axis of the board 11, said axis being indicated by the broken line 15 which also indicates the basic line of motion of the conveyance 10.

The front wheels 14 are rotatable about transverse axes on stub axles at right angles to the longitudinal axis 15 or line of motion, and each stub axle and front wheel 14 has interconnecting means in the forms of linkage 16 and transverse rod 17 whereby the wheels 14 may be turned in unison to either side of said line of motion or axis 15, the board 11 serving as a stand for a rider and being so mounted on the frame 12 as to be tiltable to either side about said axis 15 when depressed at a respective side 18 or 19 of the board 11, the latter being adapted to be disposed when desired in a substantially horizontal inoperative attitude (as in FIG. 1) in which the front wheels 14 are unturned. However, the board 11 is so connected to the interconnecting means (16,17) of the front wheels 14 that depression of the board 11 by body weight of the rider at a respective side 18 or 19 of the board causes turning of the front wheels 14 in unison in the corresponding direction. The manner in which this occurs with the prior art embodiment of FIGS. 1 and 2 will be clear from those views or alternatively from the more detailed description to be found in the earlier patent specification.

The aforedescribed components having numerals 10 to 19 inclusively are shown also, with the same numerals, in the embodiment of the present invention in FIGS. 3 to 6, except that the frame 12 supporting the board 11 for tilting of the latter about the longitudinal axis 15 includes a forward main frame assembly 20 at the axis 15 and two sub-frames 21 which are mounted in opposed dispositions on opposite sides of the main frame assembly 20, each sub-frame 21 having a transverse arm 22 rigidly connected at its outer end section 23 to the respective front wheel mounting 24, while the inner end section 25 of each transverse arm 22 is pivotally connected about an axis 26 to the main frame assembly 20 adjacent the tilt axis 15.

According to the invention, bias or damping means indicated generally at 27 is associated with the inner end sections 25 of the transverse arms 22, and it will be noted that the parts are so made and arranged that the transverse arms 22 may pivot about their inner end axes 26 under operating or load conditions against the action of the bias or damping means 27, the latter acting to return the transverse arms 22 to their initial dispositions upon cessation of said operating or load conditions.

In the same embodiment of the invention illustrated in FIGS. 3 to 6, each transverse arm 22 is V-shaped in front view, the extremities of its inner and outer end sections 25 and 23 being elevated relative to its middle section 28 at which the angle between the inner and outer sections is adapted to accommodate the adjacent edge 18*a* or 19*a* of the board 11 when the latter is tilted, thus permitting the board 11 to be mounted on the frame 12 at a level closely above the inner end sections 25 of the transverse arms 22 and their pivotal connections at 26. As apparent from the drawings and particularly from FIG. 6, the two transverse arms 22 are of the same thickness in the direction along the longitudinal axis 15, the front faces 29 being disposed in the same transverse vertical plans, while their rear faces 30 are likewise disposed in another transverse vertical plane. In this embodiment, the pivot axes 26 for the inner end sections 25 of the two transverse arms 22 are closely adjacent one another but in spaced relationship at the same height on the frame, this height as apparent from the drawings being substantially the same as the height of the transverse front wheel axes.

Figure 7:
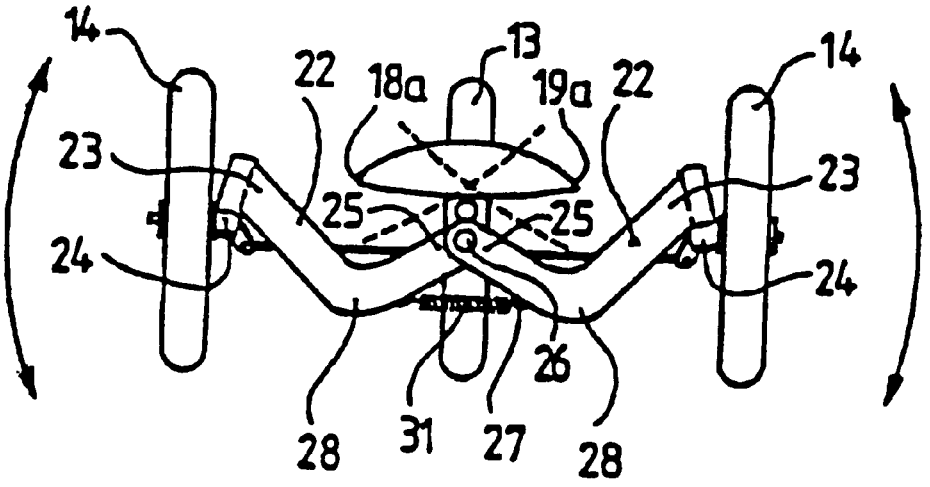
FIG. 7 is a front view of another embodiment in which the V-shaped transverse arms of the sub-frames differ in their pivotal connections to the main frame.

Instead of the two pivot axes 26 being spaced, they could be designed to coincide an a common axis 26 indicated in the modified embodiment of FIG. 7, being located on or closely adjacent the longitudinal tilt axis 15 of the board, but again being at substantially the same height as the transverse axes of the front wheels 14.

Figure 8:
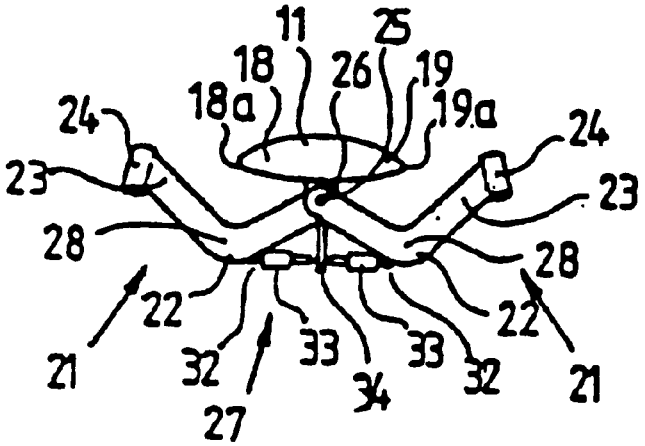
FIG. 8 is a front view of yet another embodiment, similar to that of FIG. 7 except that two tension springs are associated with the transverse arms instead of a single spring.

While the bias or damping means 27 could take any one of many forms, it is preferred that at least one simple form of tension spring be employed, a single tension spring 31 being shown in all embodiments except that of FIG. 8. Where the single tension spring 31 is used, it interconnects the two transverse arms 22 at positions 32 thereon which are equidistant from their respective pivot axes 26 and less than the distance from each pivot axis 26 to the middle of the respective arm 22.

On the other hand, when using two tension springs 33 as in the embodiment of FIG. 8, each is connected at one end to the respective inner end section of the arm 22 and at the other end to a common mounting member 34 rigid with the main frame assembly 20 adjacent the tilt axis 15, it being apparent that each transverse arm 22 will then be subject to the bias or damping action independently of the other.

As a further preferred feature of the present invention, the frame 12 has a single medial longitudinal frame member 35 of tubular metal extending beneath the board 11, its forward end having said main frame assembly 20 for connection to the sub-frames 21, while the rear end of the frame member 35 is shaped to fork-like form at 36 to accommodate a single rear wheel 13 constituting the rear wheel means for the conveyance.

The tilting arrangements for the wheels can be in accordance with the prior proposals and substantially as illustrated, and since only a very small transverse movement of the wheels results from up and down suspension movements, no provision need be made to cater for the fact that the transverse rods 17 for turning purposes are of fixed length. Nevertheless, the pertinent pivot axes (see FIG. 6 for example) are easily arranged so that parallelism is maintained, without componentry strain, by using simple parallelogram motion geometry.

The V-shaped transverse arms 22 could be replaced if desired by other sub-frame arrangements, particularly if they are disposed in front of the board instead of under the same, and different forms of bias or damping means could be used, such as a combination of spring and hydraulic dampening piston at each side if so desired. Most importantly, all components as described and illustrated could be repeated at the rear of the is conveyance if the latter were to be a four-wheel conveyance requiring steering and/or suspension at both front and rear.

While conveyances having suspension systems as described and illustrated will thus be found very effective in achieving the objects for which the invention has been devised, it is to be understood that many further modifications of constructional detail and design can be made, all of which will be readily apparent to persons skilled in the art, without departing from the broad scope and ambit of the invention, as defined by the appended claims.

I claim:

1. A sports conveyance having a substantially rectangular elongate board having a medial longitudinal axis, mounted on a frame supported at its rear by rear wheel means and at or towards its front by a pair of spaced front wheels, said spaced front wheels located at equal distances or opposite sides of the medial longitudinal axis of the board, the basic line of motion of the sports conveyance occurring along the medial longitudinal axis of the board, the front wheels being rotatable about axes transverse to said line of motion and having interconnecting means whereby they may be turned in unison to either side of said line of motion, the board serving as a stand for a rider and being so mounted on the frame as to be tiltable to either side about said medial longitudinal axis of the board when depressed at a respective side, the board being adapted to be disposed in a substantially horizontal inoperative attitude in which the front wheels are unturned but so connected to the said interconnecting means of the front wheels that depression of the board by body weight of the rider at a respective side of the board causes turning of the front wheels in unison in the corresponding direction; characterised in that the frame supporting the board for tilting of the latter about the said medial longitudinal axis of the board includes a main frame assembly and two sub-frames, the latter being mounted in opposed dispositions on opposite sides of said main frame assembly, each sub-frame having a transverse arm rigidly connected at its outer end to a respective wheel mounting, while its inner end is pivotally connected to said main frame assembly at or adjacent said medial longitudinal axis of the board, bias or damping means being associated with the inner ends of the transverse arms, and the transverse arms and bias or damping means being so made and arranged that the transverse arms may pivot about pivot axes located at their inner ends under operating or load conditions against the action of said bias or damping means, the latter acting to return the transverse arms to initial dispositions upon cessation of said operating or load conditions.

2. A sports conveyance according to claim 1 and further characterised in that each transverse arm is V-shaped in front view, its inner and outer ends being elevated relative to its middle section at which the angle between the inner and outer ends is adapted to accommodate the adjacent edge of the board when tilted, thus permitting the board to be mounted on the frame at a level closely above the inner ends of the transverse arms.

3. A sports conveyance according to claim 2 and further characterised in that the two transverse arms are of the same thickness in the direction along the medial longitudinal axis of the board, their front faces being disposed in the same transverse vertical plane, while their rear faces are disposed in another transverse vertical plane.

4. A sports conveyance according to claim 3 and further characterised in that the inner ends of the two transverse arms have their pivot axes closely adjacent but in spaced relationship at the same height on the frame and at substantially the same height as the transverse front wheel axes.

5. A sports conveyance according to claim 3 and farther characterised in that the inner ends of the two transverse arms have their pivot axes coinciding on a common axis located on or closely adjacent said medial longitudinal axis of the board, said common axis being at substantially the same height as the transverse front wheel axes.

6. A sports conveyance according to any one of the preceding claims and further characterised in that the bias or damping means includes at least one tension spring.

7. A sports conveyance according to any one of claims 1 to 5 and further characterised in that the bias or damping means includes a single tension spring interconnecting the two transverse arms at positions thereon which are equidistant from their respective pivot axes and less than the distance from each pivot axis to the middle of the respective arm.

8. A sports conveyance according to any one of claims 1 to 5 and further characterised in that the bias or damping means includes a pair of tension springs each connected between a respective transverse arm and a common mounting member rigid with the main frame assembly adjacent said longitudinal medial axis, the pair of tension springs being so made and arranged that each transverse arm is subject to bias or damping action independently of the other.

9. A sports conveyance according to any one of claims 1 to 5 and further characterised in that the frame includes a single medial longitudinal frame member extending beneath the board and constituting at its forward end said main frame assembly for connection to said sub-frames while the rear of the frame member is fork shaped to accommodate a single rear wheel constituting said rear wheel means.

10. A sports conveyance according to claim 6 and further characterised in that the frame includes a single medial longitudinal frame member extending beneath the board and constituting at its forward end said main frame assembly for connection to said sub-frames while the rear of the frame member is fork shaped to accommodate a single rear wheel constituting said rear wheel means.

11. A sports conveyance according to claim 7 and further characterised in that the frame includes a single medial longitudinal frame member extending beneath the board and constituting at its forward end said main frame assembly for connection to said sub-frames while the rear of the frame member is fork shaped to accommodate a single rear wheel constituting said rear wheel means.

12. A sports conveyance according to claim 8 and further characterised in that the frame includes a single medial longitudinal frame member extending beneath the board and constituting at its forward end said main frame assembly for connection to said sub-frames while the rear of the frame member is fork shaped to accommodate a single rear wheel constituting said rear wheel means.

* * * * *

UNITED STATES PATENT AND TRADEMARK OFFICE

CERTIFICATE OF CORRECTION

PATENT NO. : 5,924,710
DATED : July 20, 1999
INVENTOR(S) : J. de Courcey Milne

It is certified that error appears in the above-identified patent and that said Letters Patent is hereby corrected as shown below:

| COLUMN | LINE | |
|---|---|---|
| 5 (Claim 1, | 40 line 5) | "distances or" should read --distances on-- |
| 6 (Claim 5, | 25 line 1) | "farther" should read --further-- |
| 6 (Claim 8, | 46 line 6) | "longitudinal medial" should read --medial longitudinal-- |

Signed and Sealed this

Fourth Day of April, 2000

*Attest:*

*Attesting Officer*

Q. TODD DICKINSON

*Director of Patents and Trademarks*